US007001487B2

(12) United States Patent
Clarke et al.

(10) Patent No.: US 7,001,487 B2
(45) Date of Patent: Feb. 21, 2006

(54) METHOD AND APPARATUS FOR TRANSPORTING A SHEET FROM A DRYER TO A REEL

(75) Inventors: Robert L. Clarke, Appleton, WI (US); Thomas G. Neal, Jr., Appleton, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 355 days.

(21) Appl. No.: 10/025,205

(22) Filed: Dec. 19, 2001

(65) Prior Publication Data

US 2003/0111199 A1 Jun. 19, 2003

(51) Int. Cl.
*D21G 9/00* (2006.01)
*B65H 20/06* (2006.01)

(52) U.S. Cl. ..... 162/283; 162/281; 226/92; 34/117

(58) Field of Classification Search ..... 162/111–113, 162/193, 289, 363, 368, 280–281, 283; 226/91–92, 226/7, 97.3; 34/117, 120
See application file for complete search history.

(56) References Cited

U.S. PATENT DOCUMENTS 1,842,889 A * 1/1932 Williams ..... 162/283
2,857,822 A * 10/1958 Chalinor ..... 162/286
3,432,936 A * 3/1969 Greenhalgh et al. ..... 34/306
3,855,057 A * 12/1974 Hill ..... 162/301
4,036,684 A * 7/1977 Schmitt et al. ..... 162/290
4,059,482 A * 11/1977 Kankaanpaa et al. ..... 162/281
4,087,319 A 5/1978 Linkletter
4,143,828 A 3/1979 Braün et al.
4,175,714 A 11/1979 Dreher
4,283,023 A 8/1981 Braun et al.
4,726,502 A 2/1988 Cryderman
5,037,509 A 8/1991 Wedel
5,494,731 A 2/1996 Fereshtehkhou
5,531,396 A 7/1996 Kinnunen et al.
5,545,295 A * 8/1996 Fujita et al. ..... 162/358.1
5,591,309 A 1/1997 Rugowski et al.
5,593,545 A 1/1997 Rugowski et al.

(Continued)

FOREIGN PATENT DOCUMENTS

EP 0886005 A2 12/1998

(Continued)

OTHER PUBLICATIONS

PCT Search Report dated Mar. 28, 2003.

*Primary Examiner*—José A. Fortuna
(74) *Attorney, Agent, or Firm*—Dority & Manning, P.A.

(57) ABSTRACT

A system and method for transferring a continuously advancing paper web from a dryer to a reel section is provided. The system includes a first fabric defining a first moving conveyor. The first fabric may be a permeable fabric, which is positioned downstream from the dryer. A second fabric, which may also be permeable and defines a second moving conveyor, is also included. The first moving conveyor overlaps the second moving conveyor for a predetermined distance, and the first and second moving conveyors are configured to receive the paper web between the conveyors. A vacuum device is rotatably disposed against the first moving conveyor, and the dryer and the vacuum device are disposed relative to each other to form an open draw. The vacuum device is configured to produce a vacuum to attract the web to the first fabric for transferring the advancing web into the predetermined distance where the first and second conveyors overlap.

10 Claims, 4 Drawing Sheets

U.S. PATENT DOCUMENTS

| | | | | |
|---|---|---|---|---|
| 5,607,551 | A | 3/1997 | Farrington, Jr. et al. | |
| 5,762,759 | A * | 6/1998 | Wedel | 162/193 |
| 5,816,528 | A | 10/1998 | Ekströmetal. | |
| 5,846,380 | A | 12/1998 | Van Phan et al. | |
| 5,875,990 | A | 3/1999 | Svanqvist et al. | |
| 5,891,308 | A * | 4/1999 | Skaugen | 162/205 |
| 5,901,918 | A | 5/1999 | Klerelid et al. | |
| 5,918,830 | A | 7/1999 | Verajankorva et al. | |
| 5,944,273 | A | 8/1999 | Lin et al. | |
| 6,047,917 | A | 4/2000 | Ekstrom et al. | |
| 6,183,601 | B1 | 2/2001 | Otto et al. | |
| 6,227,089 | B1 | 5/2001 | Hada et al. | |
| 6,244,145 | B1 | 6/2001 | Hada et al. | |
| 6,311,921 | B1 | 11/2001 | Moller et al. | |
| 6,524,445 | B1 * | 2/2003 | Otto et al. | 162/361 |
| 6,558,514 | B1 * | 5/2003 | Rouhiainen et al. | 162/193 |
| 6,669,818 | B1 * | 12/2003 | Linden | 162/283 |
| 2003/0111199 | A1 * | 6/2003 | Clarke et al. | 162/193 |
| 2003/0159789 | A1 * | 8/2003 | Salmela | 162/193 |
| 2003/0183353 | A1 * | 10/2003 | Helgesson et al. | 162/191 |
| 2003/0221807 | A1 * | 12/2003 | Klerelid et al. | 162/111 |

FOREIGN PATENT DOCUMENTS

| | | |
|---|---|---|
| WO | WO9855384 | 12/1998 |
| WO | WO0066470 | 11/2000 |

* cited by examiner

METHOD AND APPARATUS FOR TRANSPORTING A SHEET FROM A DRYER TO A REEL

BACKGROUND OF THE INVENTION

In the manufacture of paper or tissue products such as facial tissues, bath tissues and paper towels, the base sheets are generally produced by depositing an aqueous suspension of paper making fibers onto a forming fabric, dewatering the suspension to form a web, drying the web and winding the dried web into a roll for subsequent conversion into a particular product. During manufacturing, most webs are adhered to a steam heated Yankee dryer and thereafter dislodged from the surface of the Yankee dryer by contact with a doctor blade (creping) prior to winding to improve the softness and stretch of the sheet.

In some existing processes, the final sheet traverses an "open draw" before being wound into rolls. Accordingly, the dried sheet is momentarily unsupported before being wound. In the case of creped tissue sheets, the sheet is dislodged from the creping cylinder and passed unsupported from the creping cylinder to a reel. This is true for both creped conventional (wet pressed) or creped through air dried (TAD) sheets. In addition, it is envisioned that this process could be utilized on a sheet that is not creped, similar to machine glazed (MG) grades. As known in the tissue manufacturing business, these unsupported runs or open draws are a source of sheet breaks and production delay time. To compensate, the tissue paper sheets are designed to have high strengths, particularly in the machine direction, in order to remain intact during manufacturing. However, high tissue strengths may negatively impact tissue softness, which is not desirable to the consumer.

SUMMARY OF THE INVENTION

The present invention provides a method and apparatus for transporting a sheet from a Yankee dryer, for example, to a reel, which advantageously leverages the open draw between the dryer and the reel. In so doing, tissue sheets having lower machine direction strength can be made such that the tissue sheets are softer and more substantially square shaped in terms of the machine direction and cross machine direction tensile strengths.

According to an aspect of the invention, a system for transferring a continuously advancing paper web from a dryer to a reel section is disclosed. The system has a first felt or fabric, which defines a first moving conveyor (herein, first fabric) and a second felt or fabric defining a second moving conveyor (herein, second fabric). The first fabric is positioned downstream from the dryer and may overlap the second fabric for a predetermined distance to receive the paper web between the fabrics. Ideally, the fabrics are permeable fabrics, which may have the same—but more typically—disparate levels of permeability. Permeable fabrics contemplated by the invention generally exhibit air flow in the range of 50–700 cubic feet per minute (cfm) at 125 pascals pressure drop when the fabrics are new.

The system for transferring the web may also include a vacuum device rotatably disposed against the first fabric. The vacuum device and the dryer may be arranged to form an open draw relative to each other. Optimally, the vacuum device is configured to produce a suction to attract the web to the first fabric for transferring the advancing web into the predetermined distance where the first and second fabric overlap. Further, a reel may be rotatably disposed against the second fabric. If desired, the reel and the second fabric can cooperate to advance the web to a reel spool for winding.

Optimally, a vacuum box may be provided for holding the web against the second fabric. If provided, the vacuum box is disposed adjacent the second fabric. Alternatively, a blow box for holding the web can be substituted for or supplement the vacuum box. Likewise, a static induction device can be used for holding the web in place on the fabrics.

According to another aspect of the invention, a system for transferring the advancing web from the dryer to the reel section can comprise a first felt conveyor or pick-up fabric conveyor configured to receive the web from the dryer at a pick-up point on the first felt. A delivery or second felt conveyor ideally overlaps the first felt conveyor at an overlap area disposed apart from the pick-up point. The first and second felt conveyors receive the web between the conveyors in the overlap area.

In this aspect, a lead-in roll is rotatably disposed against the first felt conveyor at a predetermined distance from the dryer such that a draw similar to that described above is formed between the dryer and the lead-in roll. The lead-in roll cooperates with the first felt conveyor to transfer the advancing web from the dryer in a direction toward the overlap area. Also, a reel is rotatably disposed against the second felt conveyor. The reel and the second felt conveyor cooperate to advance the web to a reel spool for winding the web.

The system may include a lead-in vacuum box located near the lead-in roll. In this case, the lead-in roll is disposed substantially between the dryer and the lead-in vacuum box, and the lead-in vacuum box suctions the web to the first felt conveyor as the first felt conveyor passes over the lead-in roll. If desired, an air scoop may be disposed substantially between the dryer and the lead-in roll to deflect an air mass from the dryer in a direction substantially toward the first felt conveyor. Additionally, a second vacuum box can be provided adjacent the second felt conveyor in the vicinity of the reel in a direction away from the lead-in roll.

According to another aspect of the invention, a method is disclosed for transporting the web from the dryer to the reel section. The method may include the steps of continuously advancing the web from the dryer to a first fabric belt. The first fabric belt may be arranged to run across a device located near the dryer for picking up the web. The method may include the substeps of receiving the web on the first fabric belt by the pick-up device, advancing the web on the first fabric belt in the direction of a reel drum, guiding the web between the first fabric belt and a second fabric belt, threading a continuously advancing leading end portion of the web from the second fabric belt onto a reel spool adjacent the reel drum and continuously winding the threaded web into a parent roll from the reel spool. If desired the method may also include the steps of guiding the first fabric belt and the second fabric belt around at least one shear-inducing element while the web is positioned between the belts. Ideally, the first and second belts should be sufficiently wrapped around the at least one shear-inducing element to create shear forces to act upon the web and increase the softness of the web.

BRIEF DESCRIPTION OF THE DRAWINGS

The above and other aspects and advantages of the present invention are apparent from the detailed description below in combination with the drawings in which.

Figure 1:
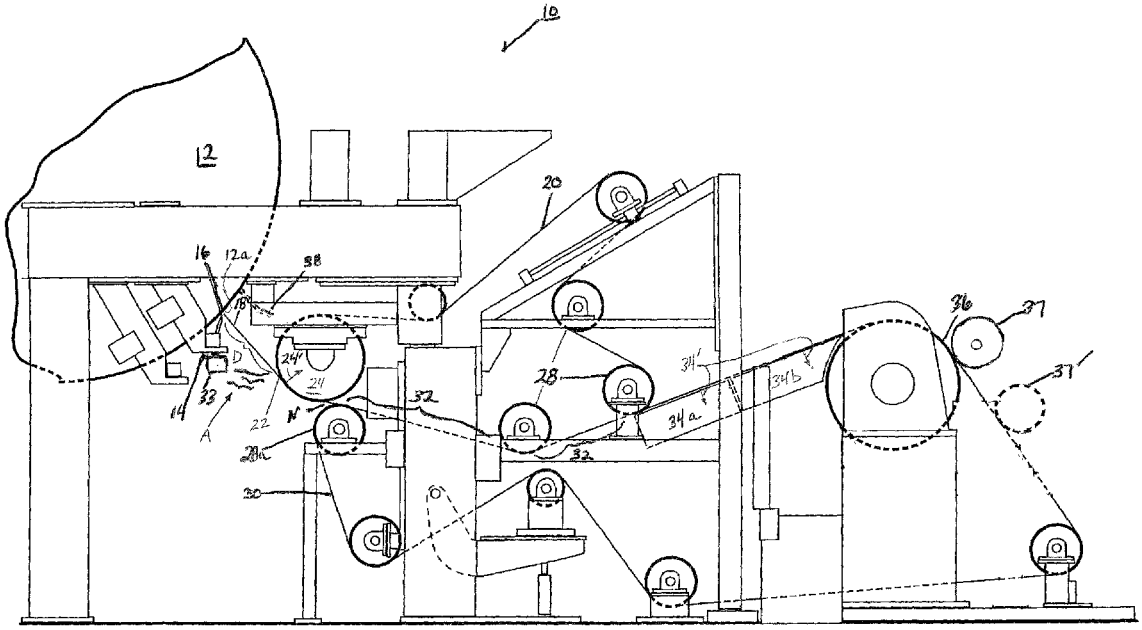
FIG. 1 is a schematic diagram of an aspect of the invention illustrating an open draw between a dryer and a lead-in roll.

Repeat use of reference characters in the present specification and drawings is intended to represent the same or analogous features or elements of the present invention.

DETAILED DESCRIPTION OF THE DRAWINGS

Detailed reference will now be made to the drawings in which examples embodying the present invention are shown. The drawings and detailed description provide a full and detailed written description of the invention, and of the manner and process of making and using it, so as to enable one skilled in the pertinent art to make and use it, as well as the best mode of carrying out the invention. However, the examples set forth in the drawings and detailed description are provided by way of explanation of the invention and are not meant as limitations of the invention. The present invention thus includes any modifications and variations of the following examples as come within the scope of the appended claims and their equivalents.

As broadly embodied in the Figures, a system for transferring a continuously advancing paper web from a dryer to a reel section is provided. In general, a transfer system 10 is shown with a dryer, for example, a Yankee dryer 12, a creping station or doctor 14, a first fabric 20 (alternatively a first felt conveyor, first fabric belt or pick-up fabric conveyor), a second fabric 30 (alternatively second felt conveyor, delivery conveyor, second fabric felt) and a reel 36 or drum 36.

Figure 2:
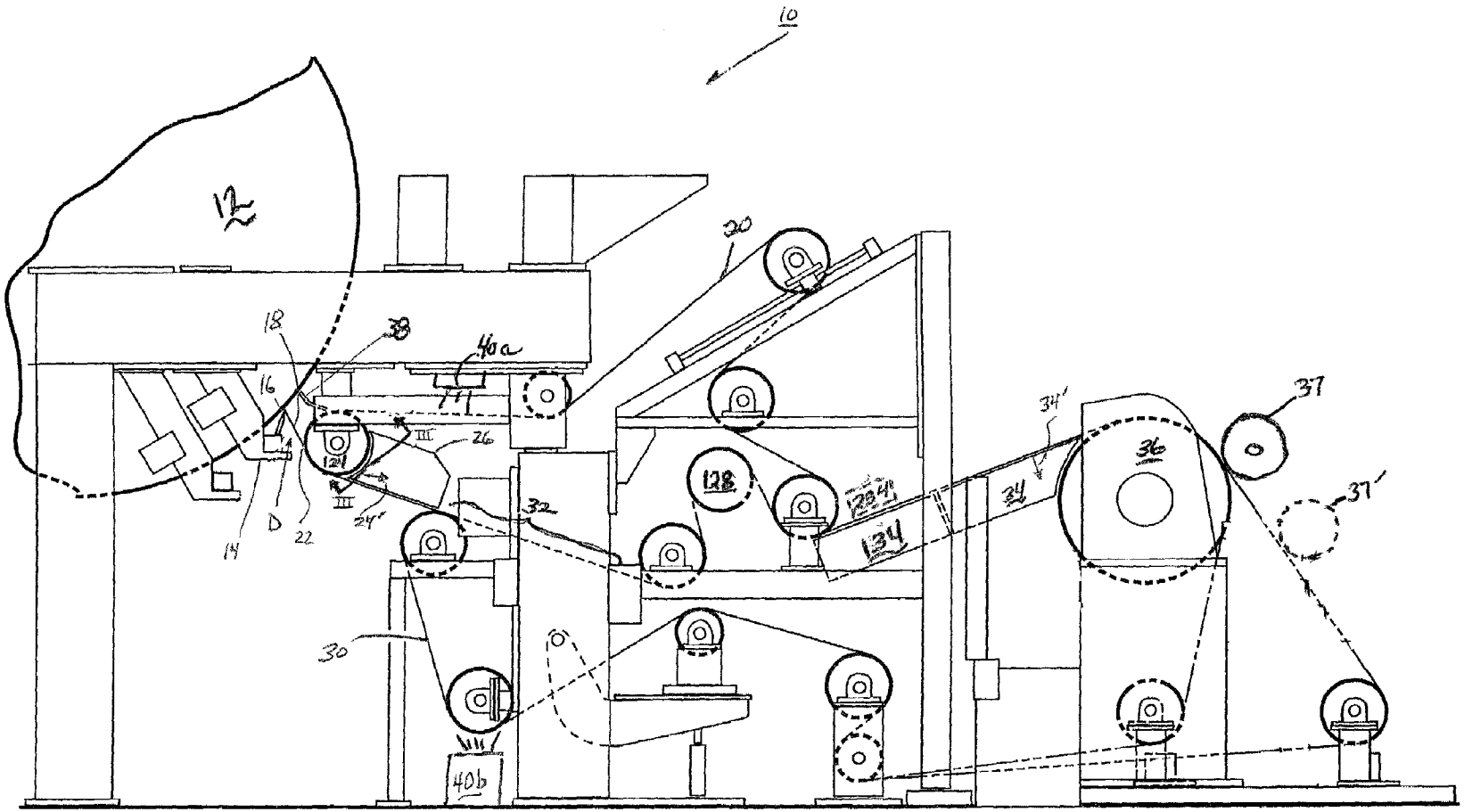
FIG. 2 is a schematic diagram of an alternative aspect of the invention.

While FIGS. 1 and 2 illustrate system 10 having a plurality of conveyor rolls 28, vacuum boxes 34*a*, 34*b* and at least two belts 20, 30, it should be understood that the following descriptions of the example embodiments are not intended to limit the present invention to use only in such pre-assembled arrangements nor are all of the foregoing elements required and other elements may be added as required. Accordingly, the present invention is suitable for use with various types of systems for transferring a paper web from a web drying system (e.g., through-air dried, flat or Yankee dryer) to various types of reel sections.

Further, it is to be noted that first fabric 20 and second fabric 30 may be permeable fabrics having the same permeability; more likely, however, first fabric 20 and second fabric 30 have different permeabilities. Also, the permeabilities of the fabrics 20, 30 may change during operation of system 10 due to repeated web W contact with fabrics 20, 30, which deposits and imbeds dust and debris on the fabrics 20, 30.

With more particular reference to the Figures, the Yankee dryer 12 is shown in FIG. 1 delivering the web 18 to the creping station 14 and across a draw D to a vacuum roll 24. In an optimal arrangement, the first fabric belt 20 is located adjacent the second fabric belt 30 such that the first fabric belt 20 picks up the web 18 on a bottom surface of the first fabric belt 20 at a pick-up point 22 and delivers the web 18 in the direction of the second fabric belt 30. The web 18 continues in a direction of the reel 36 first through an overlap area 32 disposed between th bottom surface of the first fabric 20 and a top surface of the second fabric 30, both of which may be a screen, a fabric or the like. The web 18 continues in the direction of the optional vacuum box(es) 34*a*, 34*b* and across reel 36 until it is wound onto a reel spool 37. Reel spool 37 may be a spool, a spool with a core, or a coreless system around which a web 18 winds. It is also contemplated that reel spool 37 may be arranged elsewhere on system 10, such as in a position of reel spool 37', as required.

FIG. 1 further shows an aspect of the invention in which first fabric 20 defines a first moving conveyor. The first fabric 20 is positioned downstream from the dryer 12 and is configured to pick-up and move the web 18 towards the second fabric 30 as the web 18 leaves the creping station 14. The optional creping station or doctor 14 separates and deflects the web 18 from the dryer 12 to the first fabric 20. For instance, FIG. 1 and 2 illustrate that a transfer plenum 16 may doctor off the web 18 from a surface of the dryer 12 by the transfer plenum 16 riding close to a dryer surface 12*a*. The doctor 14/transfer plenum 16 are optimally designed to divert and control boundary layer air to promote a smooth tissue or web 18 transition to the first fabric 20.

The second fabric 30 defines a second moving conveyor. The second moving conveyor 30 is overlapped by the first moving conveyor 20 as shown in FIG. 1 for a predetermined distance 32. The overlap area 32 ideally extends partially along both conveyors 20, 30 as shown in FIGS. 1 and 2 but theoretically could run from substantially near the pick-up point 22 to the reel 36. Optimally, distance 32 need only be of sufficient length to ensure web 18 is securely positioned on second moving conveyor 30. Accordingly, the first and second moving conveyors 20, 30 in FIG. 1 receive the paper web 18 between the conveyors 20, 30 which extend together toward reel 36 to hold the web 18 in place for transfer to reel 36.

In the foregoing example, vacuum device 24 may again be rotatably disposed against the first moving conveyor 20. The dryer 12 and the vacuum device 24 are then disposed relative to each other to form open draw D. The vacuum device 24 is configured to produce a suction force or vacuum, indicated by arrow 24', to attract the web 18 to the first fabric 20 for transferring the advancing web 18 into the predetermined distance 32 where the first and second conveyors 20, 30 overlap. If desired, a roll 28*a* and vacuum device 24 may be arranged to form a nip N into which the web 18 is received after the draw D.

The draw D of system 10 may have a length of between 4 inches to about 48 inches. Optimally, the open draw D defines a distance of between 10 inches to about 30 inches. The inventors have found that a draw D of approximately one foot advantageously accommodates various elements of system 10 while optimizing web 18 transfer from the creping station 14 to the first fabric 20 with fewer web 18 breaks.

As shown in FIG. 1, once the web 18 reaches the vicinity of reel 36, web 18 can be held against the second moving conveyor 30 by vacuum boxes 34*a*, 34*b*, which operate to maintain a suction, indicated by arrow 34', on the lightweight web 18 to hold it securely against the conveyor 30 until it is wound onto the reel spool. By way of example, vacuum boxes 34*a*, 34*b* may be configured to operate at a modest vacuum level of between 0.1" $H_2O$ to about 3.0" $H_2O$. Alternatively, or also, a blow box 134 or a static induction device 234 (discussed in FIG. 2 below) may be provided in lieu of or in addition to vacuum box 34 to reduce or prevent fly-up of outside edges of web 18, since web 18 may be a tissue product having a basis weight of about 2 grams per square meter (gsm) to about 65 gsm, or about 25 pounds per ream.

Figure 3:
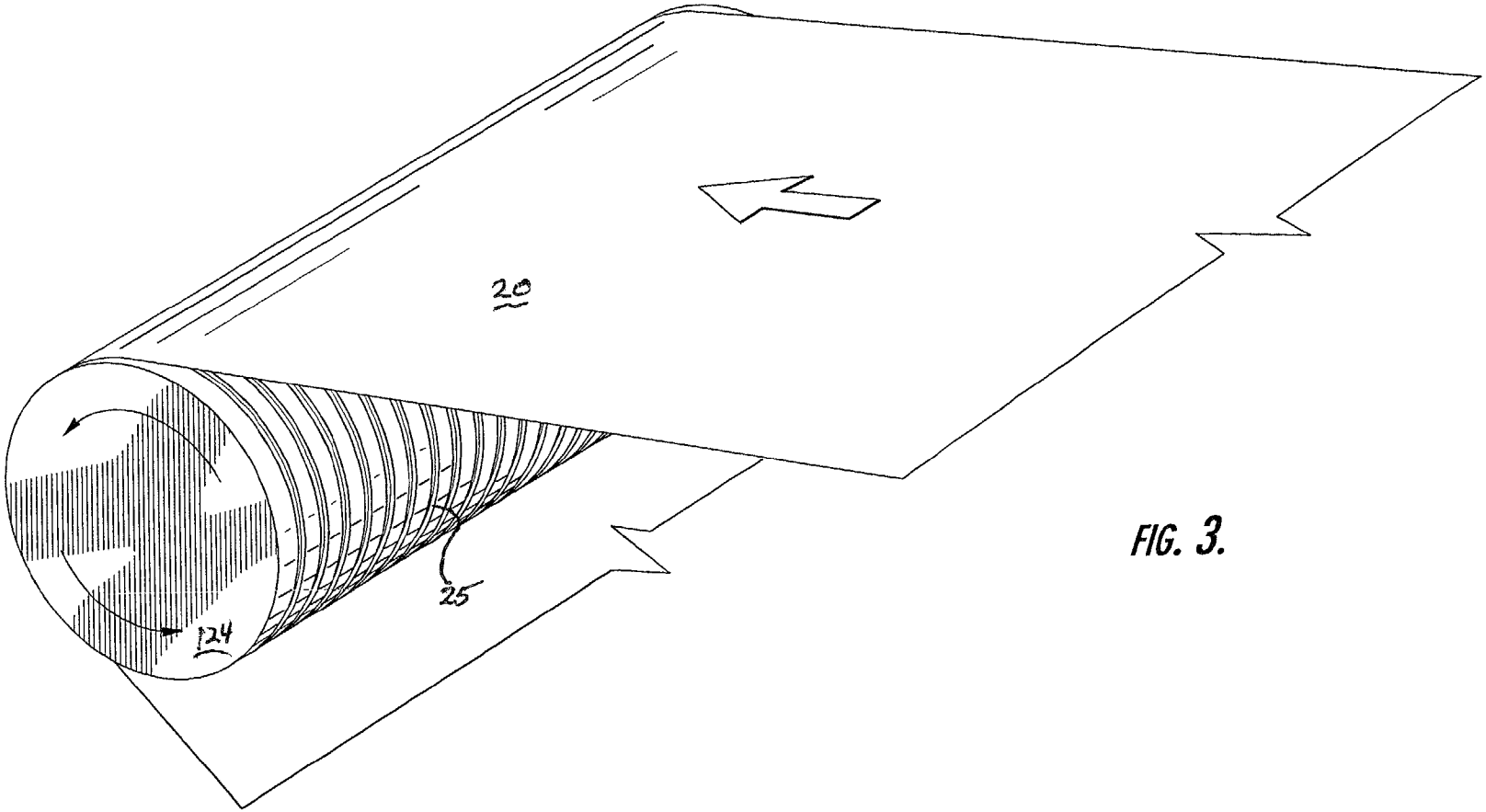
FIG. 3 is a front view of an optional grooved lead-in roll taken along line III—III in FIG. 2.

FIG. 2 illustrates another aspect of the invention in which a lead-in roll 124 is rotatably disposed against the first felt conveyor 20 a predetermined distance from the dryer 12 such that draw D is formed between the dryer 12 and the lead-in roll 124. The lead-in roll 124 cooperates with the first felt conveyor 20 to transfer the advancing web 18 from the dryer 12 in a direction toward the overlap area 32. If desired, the lead-in roll 124 may have at least one circumferential groove 25 as shown in FIG. 3 to help control boundary layer air in order to assist in the pick-up of web 18 and to hold web 18 on first felt conveyor 20 until web 18 reaches overlap area 32.

With more specific reference to the foregoing aspect, roll 124 with circumferential grooves 25 (FIG. 3) cooperates with the conveyor 20 to thread web 18 from the dryer 12 across draw D to first conveyor 20. In this aspect, tissue or web 18 can be doctored off dryer 12 and drawn by gravity at known web speeds or blown onto conveyor 20, which supports and carries the web 18 to the overlap area 32. Optionally, an air plenum 33 (FIG. 1) may be provided to blow air A in the direction of the felt conveyors 20 and 30 to help to ensure the transfer of web 18 across the draw D to conveyor 20 and towards conveyor 30.

If desired, a lead-in vacuum box 26 may be disposed adjacent the lead-in roll 124 as seen in FIG. 2. In this example, the lead-in roll 124 is thus disposed substantially between the dryer 12 and the lead-in vacuum box 26. The lead-in vacuum box 26 may be configured to attract the web 18 by suction force to the first felt conveyor 20 as the first felt conveyor 20 passes over the lead-in roll 124. As suggested, box 26 may also be a static induction device or any combination of web attraction devices to attract web 18 to lead-in roll 124 toward overlap area 32.

The exemplary embodiment of FIG. 2 can include one or more web attraction devices, such as vacuum box 34, blow box 134, or static induction device 234, as alluded to in the foregoing embodiment. By way of specific example, the vacuum box 34 is configured to help to maintain the lightweight web 18 against second conveyor 30 until web 18 reaches the reel spool 37 for wind-up.

If desired, vacuum box 34 may include blow box edges (not shown) or be otherwise configured to blow air substantially perpendicular to a direction of movement of the conveyor 30 to create venturi effects (to cause a drop in pressure) in the vicinity of conveyor 30 and assist in holding web 18 against the conveyor 30. Alternatively, web 18 may be held in place by a static induction device 234 in lieu of or in addition to vacuum box 34. The vacuum box 34 may also have replaceable plastic wear edges (not shown) to reduce wear on the fabric 20. With this option, plastic (or other suitable material) wear edges can be easily replaced instead of necessitating replacement of conveyor belts 20 due to frequent, rapid contact with edges of the boxes 34.

It should be understood that the number and placement of boxes 34, 134, 234 are not limited to the examples delineated above nor as shown in the Figures. For instance, the web attraction devices can be placed at any point along the pick-up conveyor 20 and/or delivery conveyor 30.

System 10 may further includes an air scoop 38 disposed substantially between the dryer 12 and the lead-in roll 124. The air scoop 38 is configured to deflect an air mass (not shown) from a rotation of the dryer 12 in a direction substantially toward the first felt conveyor 20 to further assist in controlled transfer of web 18 to conveyor 20.

In another aspect of the invention, at least one shear-inducing element 128 may be disposed as seen for example in FIG. 2. In this illustration, at least one of the first and second felt conveyors 20, 30 is sufficiently wrapped around the at least one shear-inducing element 128 to create shear forces that act upon the web 18 and increase the softness of the web 18. This S-wrap configuration may be located at any desired point along conveyors 20, 30 and may include a plurality of such configurations if required.

FIG. 2 also illustrates another aspect of system 10, which may include at least one device, such as exemplary devices 40*a, b*, to apply topical agents to the conveyors 20, 30 to coat the web 18. Although two devices 40*a, b* are shown, a plurality of such devices may be disposed at various other locations in system 20. Further, additional devices as well as devices 40*a, b* may be configured to each apply distinct topical agents as desired.

Figure 4:
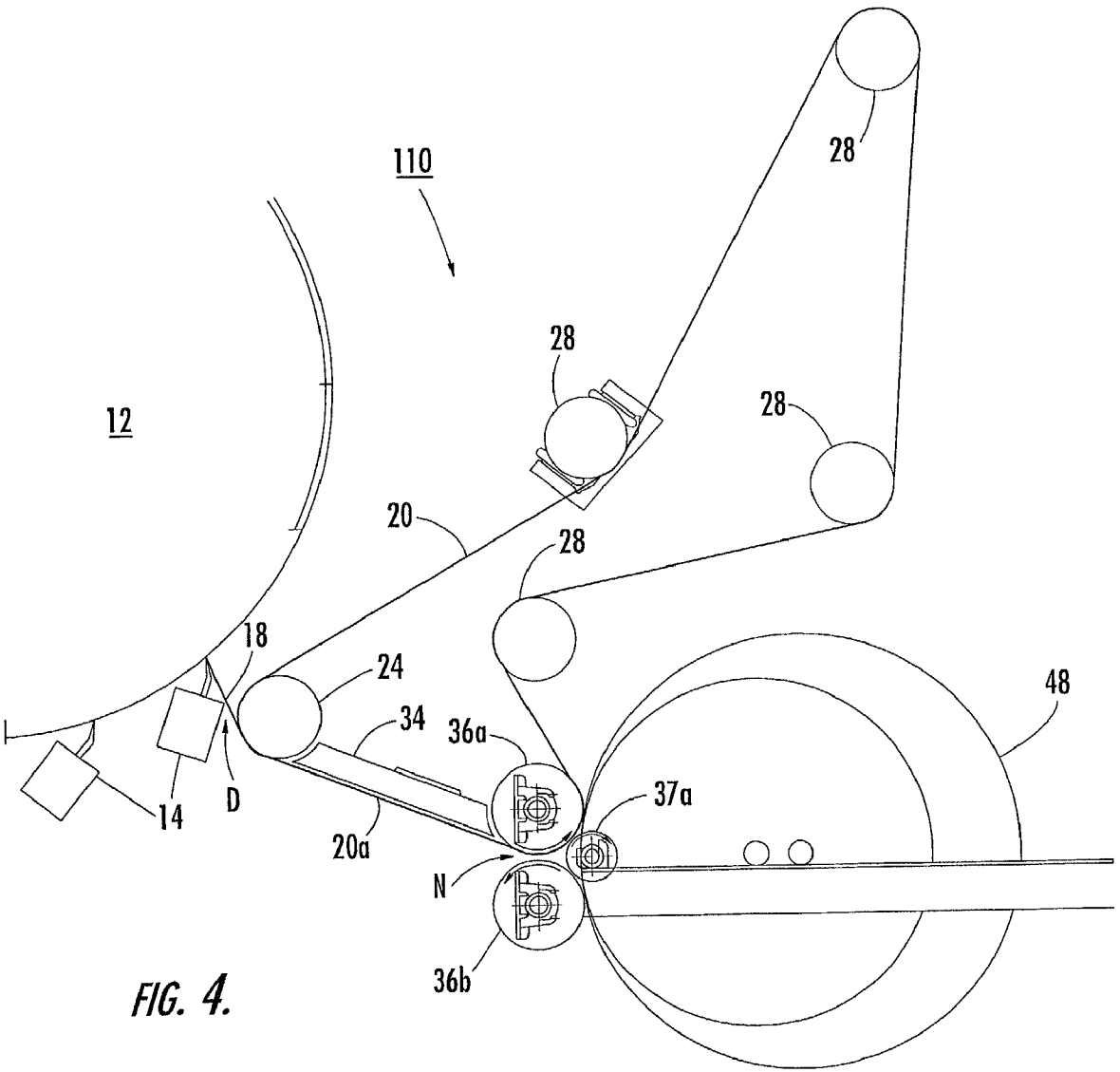
FIG. 4 is a schematic diagram of another alternative aspect of the invention.

FIG. 4 illustrates a further aspect of the present invention in which a system 110 for transferring and reeling a continuously advancing tissue web 18 from dryer 12 to a reel drum 36*a* until it is wound onto a reel spool 37*a*. A second reel drum 36*b* may be used in combination with reel drum 36*a* to assist in winding a parent roll 48. The system 110 may have only one conveyor 20, which is positioned downstream from the dryer 12 such that draw D is formed between the conveyor 20 and the dryer 12 in an arrangement similar to the foregoing embodiments. Accordingly, the conveyor 20 is configured to continuously receive the web 18 across the draw D and continuously advance the web 18, in contact with a bottom side 20*a* of conveyor 20 in the direction of the reel drum 36*a* located within a conveyor loop formed by conveyor 20.

According to another aspect of the invention, a method is disclosed for transporting the web 18 from the dryer 12 to the reel section 36 comprising the step of continuously advancing the web 18 from the dryer 12 to the first fabric belt 20. The first fabric belt 20 may be permeable and is optimally arranged proximate the dryer 12 for picking up the web 18 as described above. Further steps may include receiving the web 18 on the first fabric belt 20 by the pick-up point 22, advancing the web 18 on the first fabric belt 20 in the direction of a reel drum 36, guiding the web 18 between the first fabric belt 20 and a permeable second fabric belt 30, threading a continuously advancing leading end portion (not shown) of the web 18 from the second fabric belt 30 onto a reel spool 37 adjacent the reel drum 36, and continuously winding the threaded web 18 into a parent roll (not shown) from the reel spool 37.

The method may also include the steps of guiding the first fabric belt 20 and the second fabric belt 30 around the at least one shear-inducing element 128 while the web 18 is positioned between the belts 20, 30. In this example, the first and second belts 20, 30 should be sufficiently wrapped around the at least one shear-inducing element 128 so as to create shear forces that act upon the web 18 to increase the softness of the web 18 as desired by the consumer.

It will be apparent to those skilled in the art that various modifications and variations can be made in the present invention without departing from the scope and spirit of the invention. For example, specific shapes, quantities, and arrangements of various elements of the illustrated embodiments may be altered to suit particular applications. It is intended that the present invention include such modifications and variations as come within the scope of the appended claims and their equivalents.

That which is claimed is:

1. A system for transferring a continuously advancing tissue web from a dryer to a reel section comprising:

a first fabric defining a first moving conveyor with a bottom surface, the first fabric being positioned downstream from the dryer;

a second fabric defining a second moving conveyor with a top surface, the first moving conveyor overlapping the second moving conveyor for a predetermined distance, the first and second moving conveyors being configured to receive a creped tissue web between the conveyors; and a vacuum device rotatably disposed against the first moving conveyor, the dryer and the vacuum device disposed relative to each other to form an open draw therebetween, the vacuum device configured to produce a suction to pull the creped tissue web to the bottom surface of the first fabric across the open draw for transferring the advancing tissue web into the predetermined distance where the first and second conveyors overlap.

2. The system of claim 1, wherein the open draw defines a distance of between 4 inches to about 48 inches.

3. The system of claim 1, wherein the open draw defines a distance of between 10 inches to about 30 inches.

4. The system of claim 1, further comprising holding means for holding the web against the second moving conveyor.

5. The system of claim 4, wherein the holding means for holding the web is a vacuum box.

6. The system of claim 5, wherein the vacuum box is configured to produce a vacuum pressure of between 0.1 inches of water to about 3.0 inches of water.

7. The system of claim 4, wherein the holding means for holding the web is a blow box.

8. The system of claim 4, wherein the holding means for holding the web is a static induction device.

9. The system of claim 1, further comprising a creping station, the creping station configured to separate and deflect the web from the dryer to the first fabric.

10. A system for transporting an advancing tissue web comprising:

a pick-up fabric conveyor defining a bottom surface, the bottom surface configured to receive and transport the tissue web across an open draw between a dryer and the pick-up fabric conveyor;

a delivery conveyor defining a top surface disposed in partial moving engagement with the bottom surface of the pick-up fabric conveyor along a length of each of the delivery and pick-up fabric conveyors, the delivery and pick-up fabric conveyors being configured to receive the tissue web between the conveyors; and transferring means for transferring the tissue web from the draw to the bottom surface of the pick-up fabric conveyor, the transferring means disposed against the pick-up fabric conveyor and at least partially between the dryer and the delivery conveyor, the transferring means cooperative with the bottom surface of the pick-up fabric conveyor for transferring the advancing tissue web from the pick-up fabric conveyor to between the conveyors in the direction of a reel assembly.

* * * * *